US012415123B2

(12) United States Patent
Zhang

(10) Patent No.: US 12,415,123 B2
(45) Date of Patent: Sep. 16, 2025

(54) BOXING TRAINING INFLATION DEVICE

(71) Applicant: Xuelian Zhang, Suzhou (CN)

(72) Inventor: Xuelian Zhang, Suzhou (CN)

( * ) Notice: Subject to any disclaimer, the term of this patent is extended or adjusted under 35 U.S.C. 154(b) by 116 days.

(21) Appl. No.: 18/518,546

(22) Filed: Nov. 23, 2023

(65) Prior Publication Data

US 2025/0090925 A1 Mar. 20, 2025

(30) Foreign Application Priority Data

Sep. 18, 2023 (CN) ..... 202311198871.4

(51) Int. Cl.
*A63B 69/20* (2006.01)

(52) U.S. Cl.
CPC ..... *A63B 69/20* (2013.01); *A63B 2225/62* (2013.01); *A63B 2244/102* (2013.01)

(58) Field of Classification Search
CPC ..... A63B 69/20; A63B 69/215; A63B 69/22; A63B 69/222; A63B 69/224; A63B 69/24; A63B 69/244; A63B 69/26; A63B 69/28; A63B 69/30; A63B 69/305; A63B 69/32; A63B 69/322; A63B 69/325; A63B 2244/102; A63B 2225/62; A63B 2225/093; A63B 2071/026
See application file for complete search history.

(56) References Cited

U.S. PATENT DOCUMENTS 7,150,700 B2 * 12/2006 MacKay ..... A63B 69/222 482/83
11,691,063 B2 * 7/2023 Luigi ..... A63B 69/20 482/83
D1,006,935 S * 12/2023 Zhu
D1,032,763 S * 6/2024 Zhang
2022/0161116 A1 * 5/2022 Curry ..... A63B 69/22
2024/0123312 A1 * 4/2024 Wu ..... A63B 69/22

FOREIGN PATENT DOCUMENTS

GB 2524546 A * 9/2015 ..... A63B 69/004

* cited by examiner

*Primary Examiner* — Megan Anderson
(74) *Attorney, Agent, or Firm* — JEEN IP LAW, LLC

(57) ABSTRACT

The present disclosure provides a boxing training inflation device, the device is provided with a rotating component that connects an inflation column and a strike column, the inflation column is fixed through a base body. The strike column is provided with an impact arm, which is arranged in a row and distributed on left and right sides of the strike column, a trainer uses his fists and feet to strike the impact arm. When subjected to an external force, the impact arm will form a linkage with the strike column; and thus, a rotating disc is driven to rotate on a fixed disc by the strike column. Compared to traditional immovable sandbags, the boxing training inflation device can more effectively train trainer' reaction ability, the training content is more diverse, and it has the advantages of flexible use, strong antagonism, stable structure, and strong resistance to strike.

8 Claims, 9 Drawing Sheets

BOXING TRAINING INFLATION DEVICE

CROSS-REFERENCE TO RELATED APPLICATIONS

This application claims priority to Chinese Patent Application No. 202311198871.4, filed on Sep. 18, 2023, which is hereby incorporated by reference in its entirety.

TECHNICAL FIELD

The present disclosure relates to the field of sports equipment technologies, and in particular, to a boxing training inflation device.

BACKGROUND

Boxing cannot be simply understood as a confrontational sport involving wearing boxing gloves. In ancient Greece and Rome, it began with bare fists and developed into leather straps for reinforcement. Modern boxing began with the legal prohibition of sword duels and remained a bare fisted sport until boxing learned to introduce gloves into the rules that must be followed in boxing competitions. Narrowly defined as the sport of wearing boxing gloves to engage in combat, which includes both amateur (also known as Olympic boxing) and professional competitions. The goal of the competition is to score more points than the opponent to defeat or knock them down and end the competition. At the same time, the competitor should strive to avoid the opponent's blows.

In the training and practice of boxing schedules, trainers often use boxing bags. However, the internal filling of existing boxing bags is mostly sand, which is inconvenient to carry. Moreover, existing boxing bags are usually integrally formed and cannot be partially rotated, and the training method is relatively single.

SUMMARY

The purpose of the present disclosure is to overcome the shortcomings of existing technology and provide a boxing training inflation device. The boxing training inflation device is provided with a rotating component that connects an inflation column and a strike column; the inflation column is fixed through a seat body, so that only the strike column can rotate. The strike column is provided with an impact arm, which is arranged in a row and distributed on two sides of the strike column. A trainer strikes the impact arm through his fists and feet, when the impact arm is subjected by an external force, it will form a linkage with the strike column, a rotating disc is driven to rotate on a fixed disc by the strike column. Compared to traditional immovable sandbags, it can more effectively trainer' reaction ability. Trainers can dodge or block the impact arm, the training content is more diverse. It has the advantages of flexible use, strong interest, stable structure, and strong resistance to strike.

The purpose of the present disclosure is achieved through the following technical solutions.

A boxing training inflation device, including a base, which can improve a stability of the training inflation device. The base is provided with an inflation column, which limits a movement direction of the inflation column. The inflation column and its components will not fall when being struck, and there is a strike column on the inflation column that can be struck. There is a rotating component connecting the strike column and the inflation column between the inflation column and the strike column, so that the strike column can rotate, a flexibility and interest of a competition training are improved. The rotating component is composed of two parts, one part is fixed at an upper end of the inflatable column, which is a fixed disc, and the other part is provided at a lower end of the strike column, which is a rotating disc. Two sides of the strike column are further provided with an impact arm, which form a linkage with the strike column when being subjected by an external force, the rotating disc is driven to rotate on the fixed disc by the strike column. Compared to traditional immovable sandbags, it can more effectively trainer's reaction ability, and the impact arm can replace the coach's striking behavior when rotating. Trainer can dodge or block the impact arm, and there is a locking disc between the fixed disc and the rotating disc that locks the two longitudinally, renders it impossible for the rotating disc to detach from the fixed disc during rotation. During the training process, trainers can exert their strength without worrying about damage to the inflation device during boxing training.

In an embodiment, an inner of the base is in a shape of a cavity accommodating air and liquid. The weight of the base is enhanced by injecting liquid, which can effectively counteract the impact force. The gas injection causes the base to bulge, which can support the inflation column. A side wall of the base is provided with a water injection hole and a puncture, and the water injection hole and the puncture are respectively provided with a plug for liquid and gas injection. The plug is connected to a detachable plug body, the plug is further provided with a backstop member, and the plug on the water injection hole may not be provided with the backstop member. The inflation column and the side wall of the strike column are both provided with the puncture, and the puncture is provided with the plug for air inlet. After being filled with air, the inflation column and the strike column completely bulge and tighten the surface, which is elastic and can provide feedback on strike.

In an embodiment, a roller piece is clamped between the rotating disc and the fixed disc to reduce a friction force between the two during rotation. The roller piece is provided with a circular belt, multiple spheres are on the circular belt. A middle of the fixed disc is provided with a placement groove for placing the roller piece to prevent displacement of the circular belt during training, which can cause device damage. The rotating disc is provided with a horizontal plane tangent to the sphere. A contact area is small; and thus, effectively reducing friction. A middle of the fixed disc is provided with a screw seat for forming a fit with the locking disc. The screw seat is provided with multiple threaded holes, and the locking disc is provided with an opening for inserting a screw. The installation is simple, and the fixing effect is good.

In an embodiment, the circular belt is provided with a limit ring to limit the sphere; a bottom of the limit ring is provided with an opening for inserting the sphere. The limit ring gradually shrinks from bottom to top, and a height of the limit ring is lower than that of the sphere. An upper end of the sphere protrudes from the limit ring, and after the sphere is placed, its top is exposed from a top of the limit ring to contact the rotating disc, so as to further reduce friction, lubricating oil can be applied to a surface of the sphere.

In an embodiment, the impact arm and the strike column are integrally formed, and an air holding chamber provided in the impact arm is communicated with the cavity for holding air provided in the strike column. After being filled with air, the strike column and impact arm bulge together, and a front side and a rear side of the impact arm are horizontal planes. During training, the first or foot is better in contact with it.

In an embodiment, the backstop member is provided with a shield piece and an air passage seat, and the air passage seat is provided with multiple air passage holes. The air passage seat is arranged in the plug, and the air passage seat and the plug are detachably connected. The air passage seat can be removed from the plug for exhaust, and the shield piece is provided at a tail end of the air passage seat. The shield piece has elasticity, which allows the shield piece to deform under the airflow, exposing the air passage hole, and the airflow enters the chamber, if the injection of air flow is stopped, the shield piece can be reset, and the air passage seat can be closed. The air flow in the chamber cannot flow out. Only by removing the air passage seat from the plug, and air or liquid can be discharged.

In an embodiment, a middle of the air passage seat for fixing the shield piece is provided with a connection seat, a hole is provided in a middle of the connection seat for the shield piece to pass through, a column is provided in a middle of the shield piece, and a titled circular platform provided in a middle of the column is an insertion head. The insertion head can be clamped onto the connection seat after insertion, and the shield piece cannot detach from the connection seat when pushed away by the airflow.

In an embodiment, a diameter of the base is greater than a diameter of the inflation column and greater than a diameter of the strike column, and an outer side of the impact arm is arranged within a diameter range of the base to ensure the stability of the boxing training inflation device.

The beneficial effects of the present disclosure are as following:

a rotating component connects the inflatable column and the strike column, which allows the strike column to rotate around the inflatable column. There is a strike arm arranged in a row on two sides of the strike column. A trainer strikes one side of the strike arm, and the other side will swing towards the trainer under an impact force; and thus, simulating a strike. The trainer can perform dodge or block training, which enhances an interaction between the trainer and the training device compared to traditional fixed sandbag. A stable connection between the inflatable column and the strike column is ensured through the rotating component, and the base ensures that the entire training device will not collapse under force. It has the advantages of flexible training, strong resistance, stable structure, and strong resistance to strike.

BRIEF DESCRIPTION OF DRAWINGS

In order to provide a clearer explanation of the technical solution of the embodiments of the present disclosure, a brief introduction will be given to the drawings required in the embodiments. It should be understood that the following drawings only illustrate certain embodiments of the present disclosure, and therefore should not be regarded as limiting the scope. For ordinary technical personnel in the art, other relevant drawings can also be obtained based on these drawings without creative work.

Figure 1:
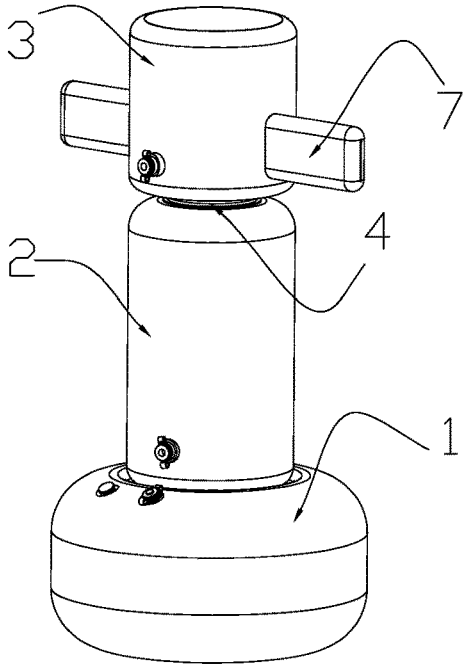
FIG. 1 is a first structural diagram of the present disclosure.

Numeral reference: base 1, inflation column 2, strike column 3, rotating component 4, fixed disc 5, rotating disc 6, impact arm 7, locking disc 8, water injection hole 9, puncture 10, plug 11, plug body 12, backstop member 13, roller piece 14, circular belt 15, sphere 16, placement groove 17, screw seat 18, limit ring 181, shield piece 19, air passage seat 20, air passage hole 21, connection seat 22, insertion head 23.

DESCRIPTION OF EMBODIMENTS

In order to facilitate the understanding of the present disclosure, a more comprehensive description will be provided below with reference to the relevant drawings. The preferred embodiments of the present disclosure are shown in the drawings. However, the present disclosure can be implemented in many different forms, not limited to the embodiments described herein. On the contrary, the purpose of providing these embodiments is to provide a more thorough and comprehensive understanding of the disclosed content of the present disclosure.

It should be noted that when a component is referred to as "fixed to" another component, it can be directly attached to another component or there can be a component between herein. When a component is considered to be "connected" to another component, it can be directly connected to another component or there may be a component present between herein. Terms "vertical", "horizontal", "left", "right", and similar expressions used in the present description are for illustrative purposes only and do not necessarily represent the only implementation mode.

Unless otherwise defined, all technical and scientific terms used in the present disclosure have the same meanings as those commonly understood by those skilled in the technical field of the present disclosure. Terms used in the specification of the present disclosure in the present disclosure are only for the purpose of describing specific embodiments and are not intended to limit the present disclosure. Term "and/or" used in the present disclosure includes any and all combinations of one or more related listed items.

Figure 2:
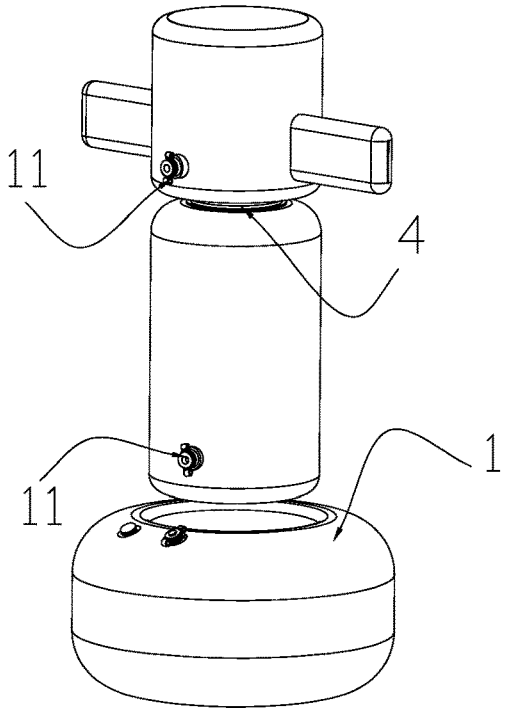
FIG. 2 is a second structural schematic diagram of the present disclosure.
Figure 3:
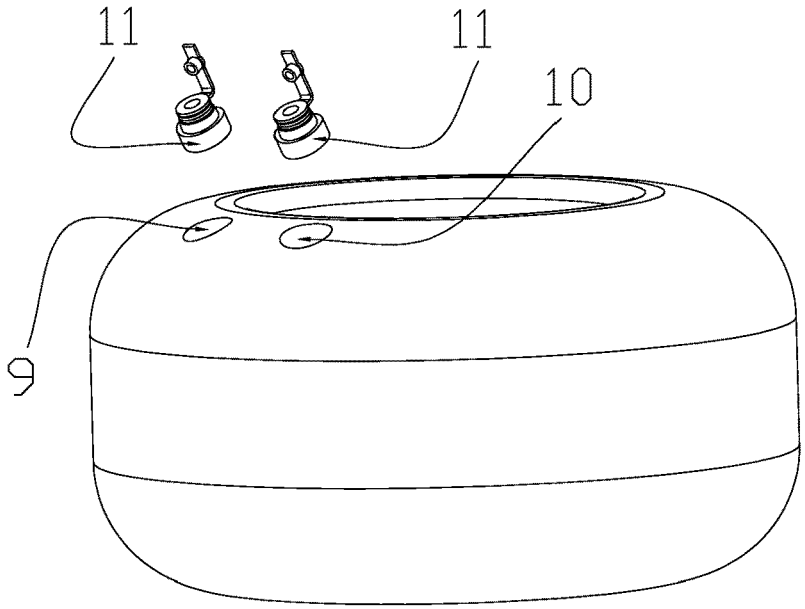
FIG. 3 is a structural schematic diagram of a base of the present disclosure.
Figure 4:
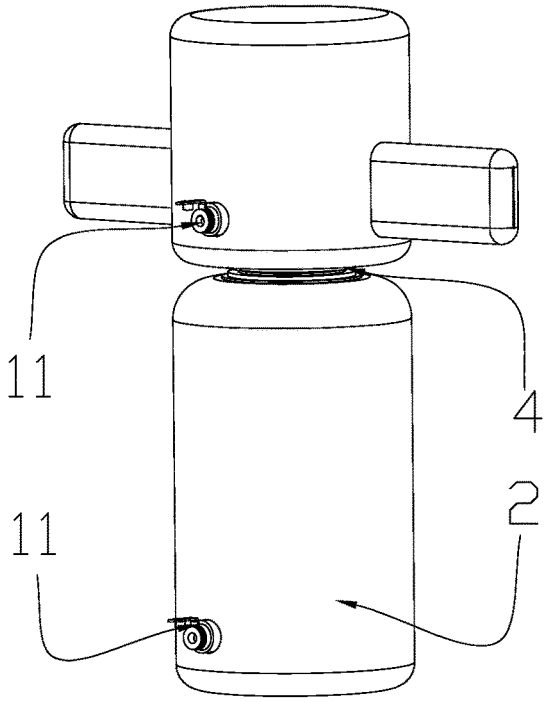
FIG. 4 is a structural schematic diagram of an inflatable column of the present disclosure.
Figure 5:
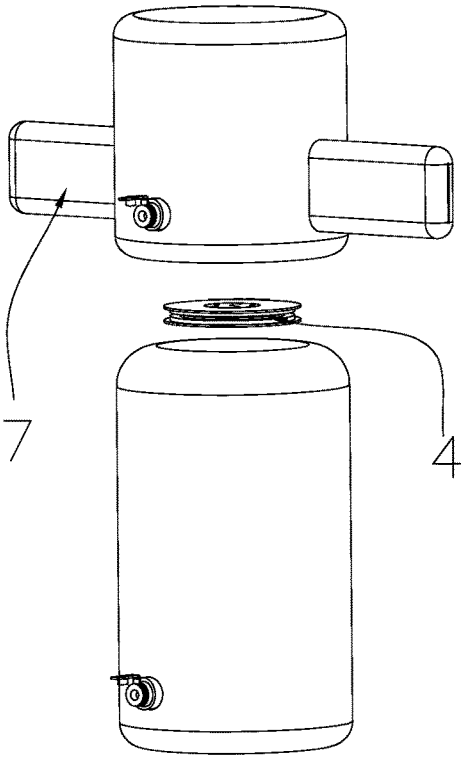
FIG. 5 is a first structural schematic diagram of a rotating component of the present disclosure.
Figure 6:
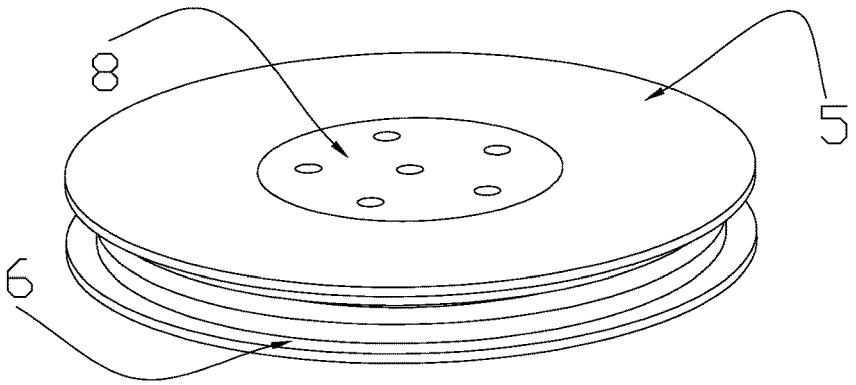
FIG. 6 is a second structural schematic diagram of the rotating component of the present disclosure.
Figure 7:
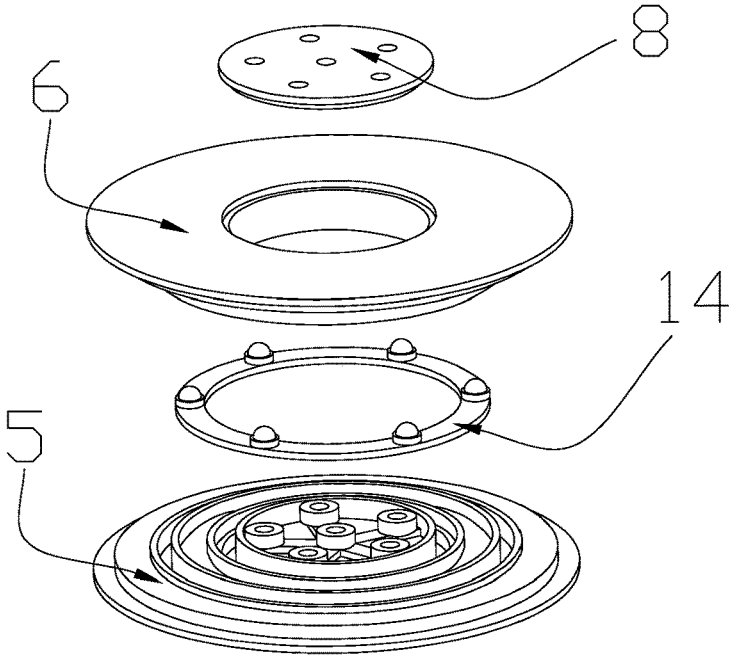
FIG. 7 is a structural exploded view of the rotating component of the present disclosure.
Figure 8:
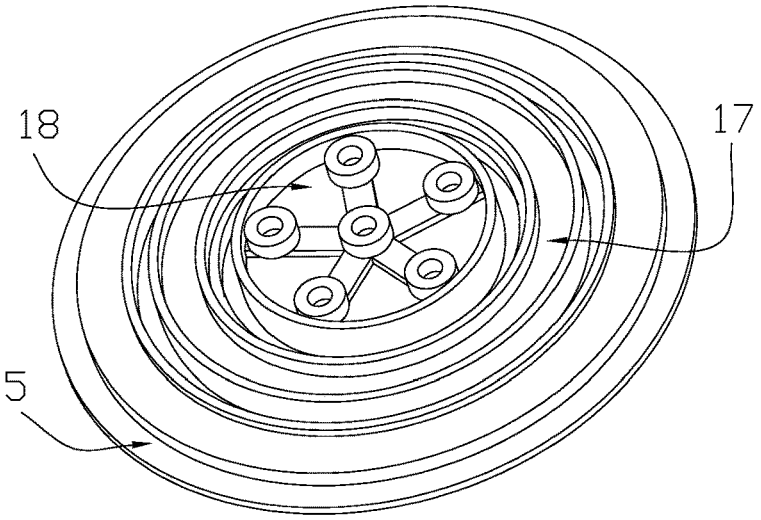
FIG. 8 is a structural schematic diagram of a novel fixed disc of the present disclosure.
Figure 9:
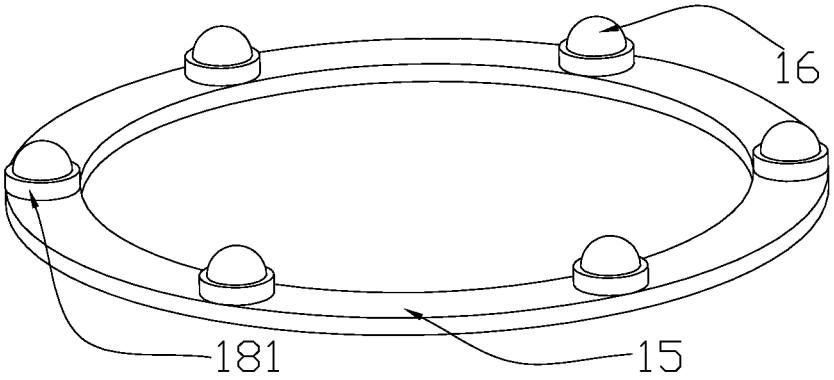
FIG. 9 is a structural schematic diagram of a novel roller piece of the present disclosure.
Figure 10:
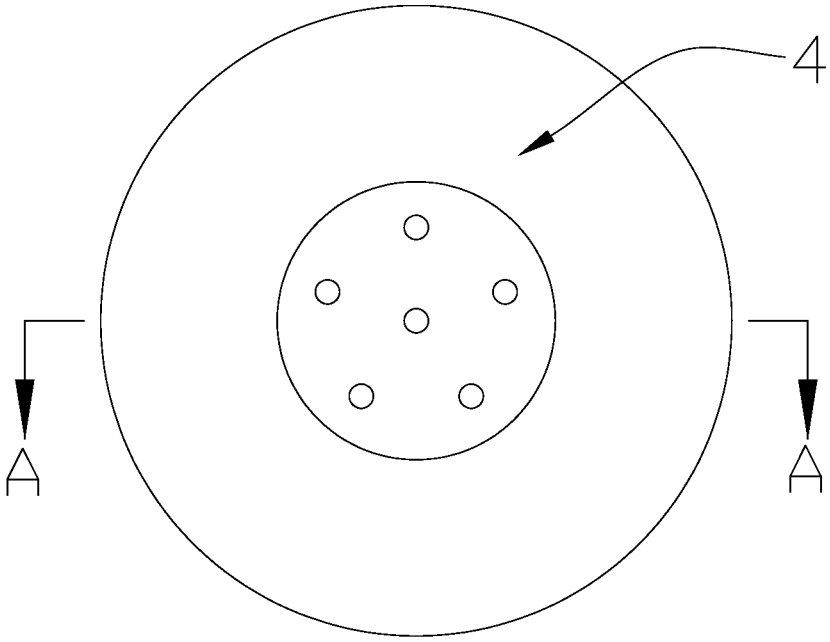
FIG. 10 is a top view of the rotating component of the present disclosure.
Figure 11:
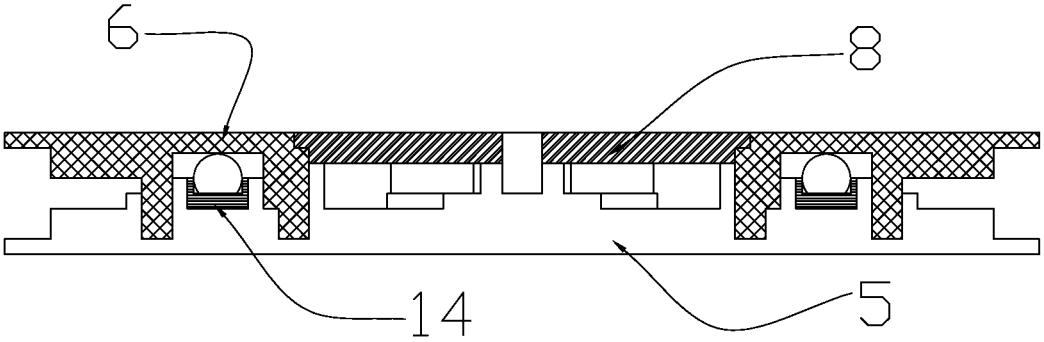
FIG. 11 is a cross-sectional view of FIG. 10 along A-A direction of the present disclosure.
Figure 12:
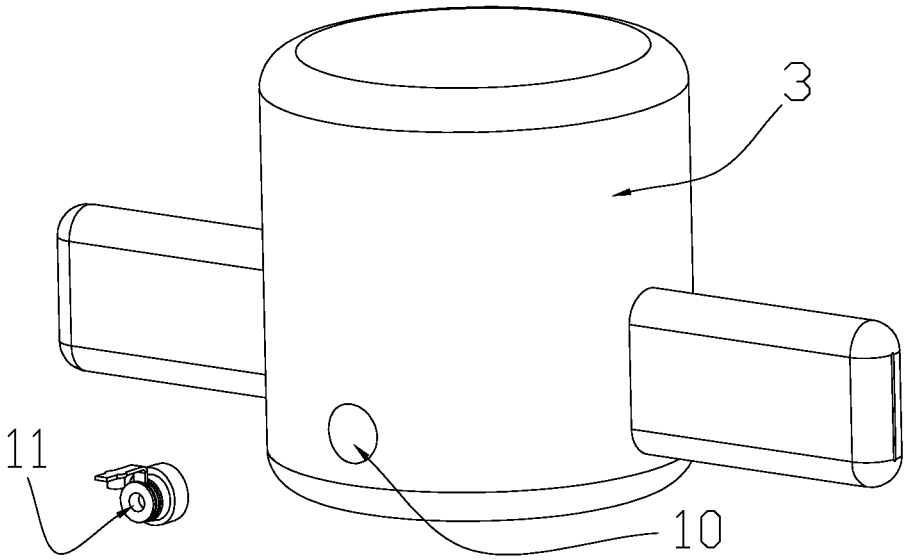
FIG. 12 is a structural schematic diagram of a novel strike column of the present disclosure.
Figure 13:
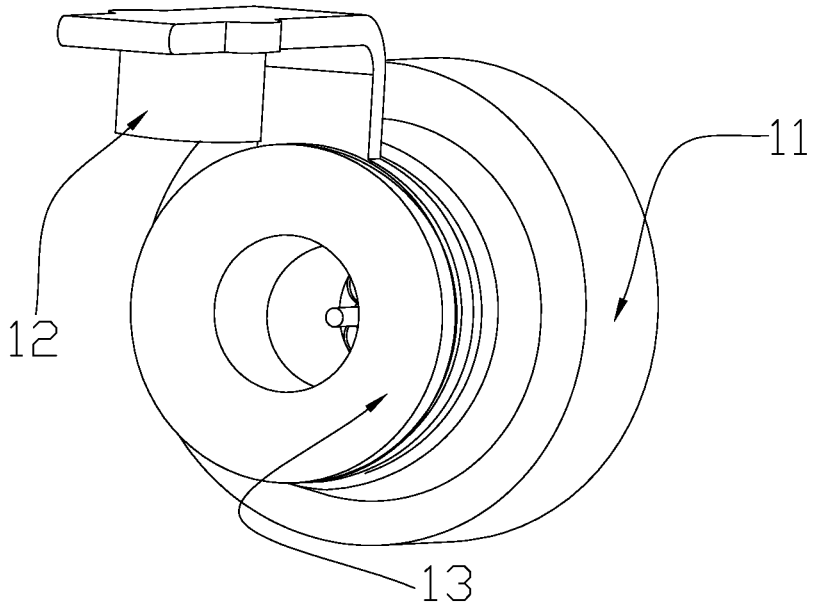
FIG. 13 is a first structural schematic diagrams of a plug of the present disclosure.
Figure 14:
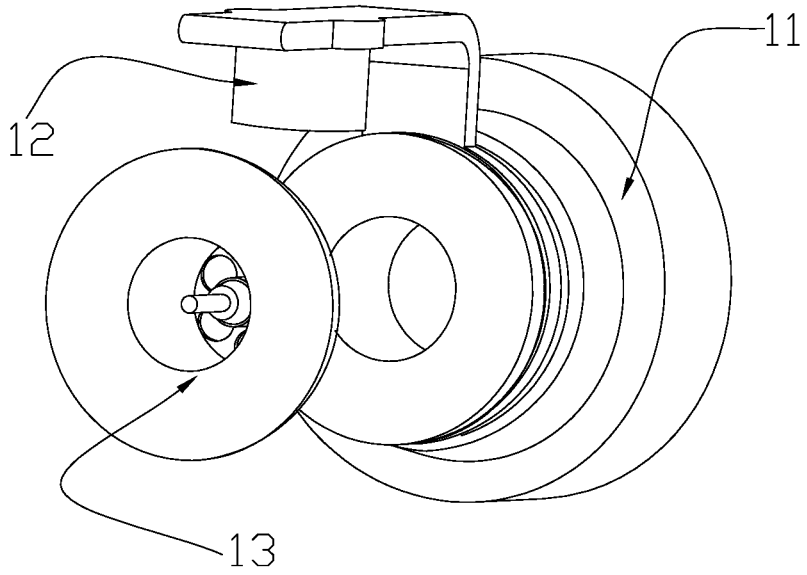
FIG. 14 is a second structural schematic diagram of the plug of the present disclosure.
Figure 15:
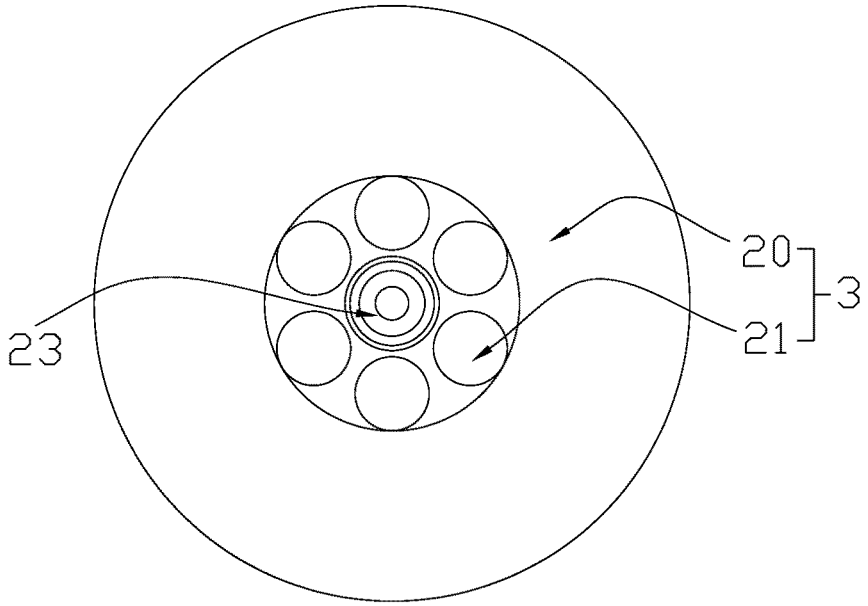
FIG. 15 is a first structural schematic diagram of a backstop member of the present disclosure.
Figure 16:
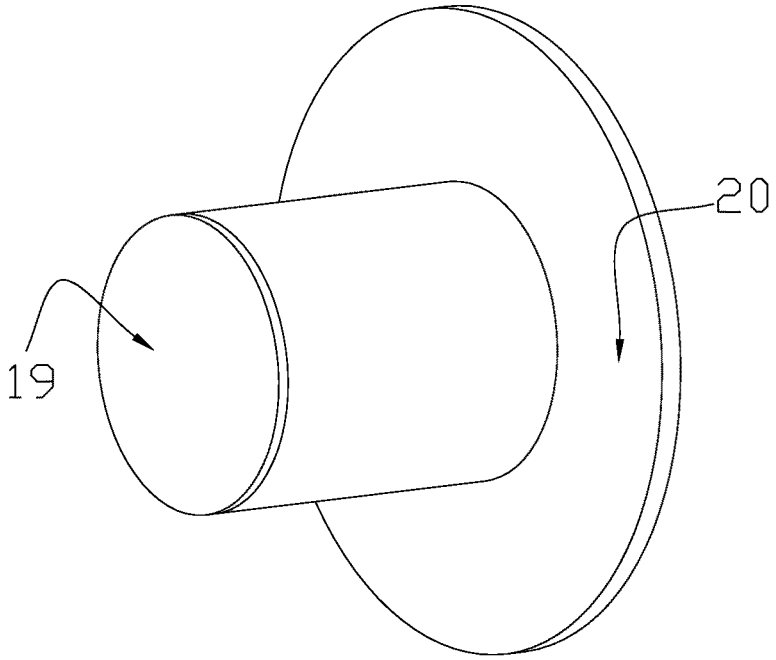
FIG. 16 is a second structural schematic diagram of the backstop member of the present disclosure.
Figure 17:
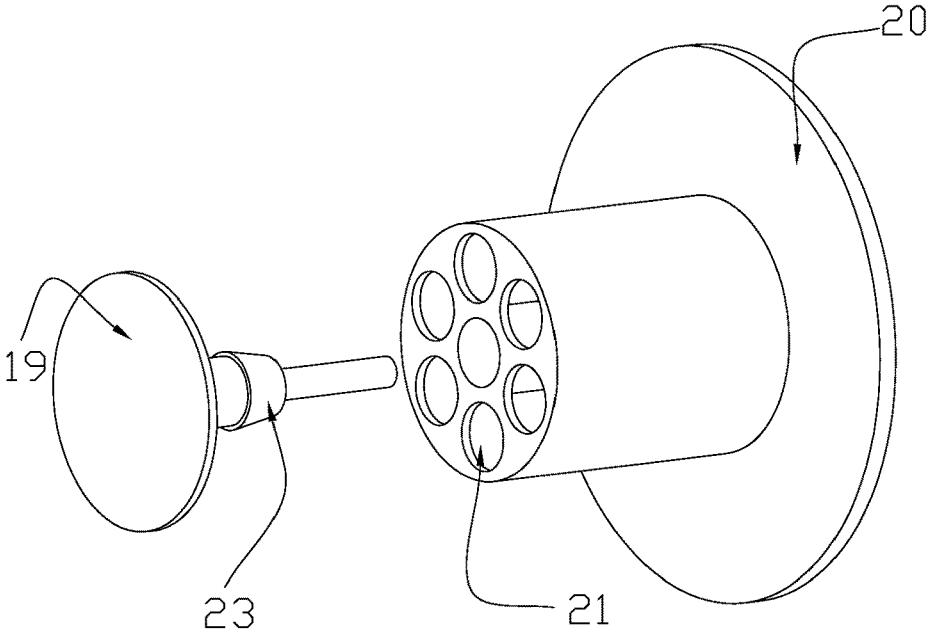
FIG. 17 is a structural exploded view of the backstop member of the present disclosure.
Figure 18:
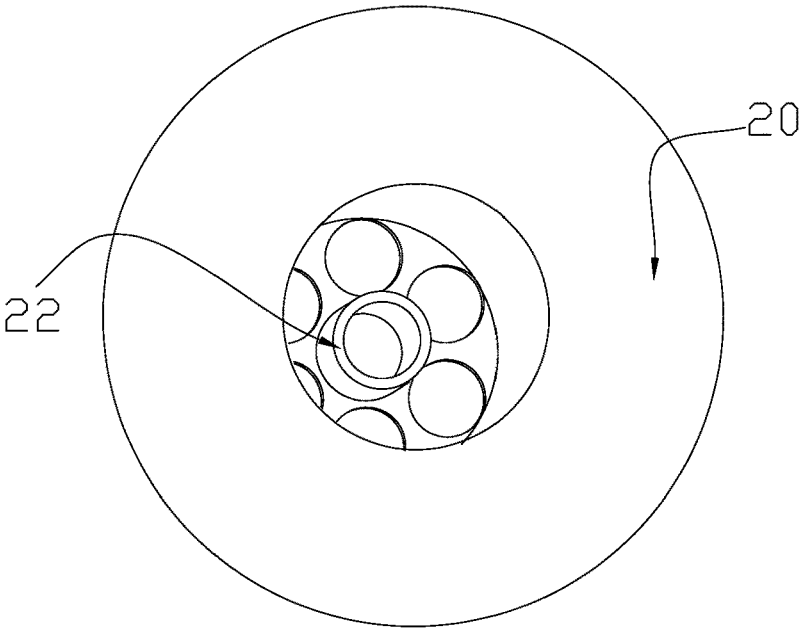
FIG. 18 is a structural schematic diagram of a connection seat of the present disclosure.

Please refer to FIGS. 1-18: a boxing training inflation device, including a base 1, which is provided with an inflation column 2. The base 1 limits a movement direction of the inflation column 2. When the inflation column 2 receives an impact force, the base 1 can counteract the impact force to prevent the training device from falling down. The inflation column 2 is provided with a strike column 3 that can be struck. During training, trainers conduct strike training on it, there is a rotating component 4 connecting the inflatable column 2 and the strike column 3, the rotating component 4 is composed of two parts. One part is fixed at an upper end of the inflatable column 2, which is a fixed disc 5, and the other part is provided at a lower end of the strike column 3, which is a rotating disc 6. Two sides of the strike column 3 are further provided with an impact arm 7, which is arranged in a straight line. When the impact arm 7 is subjected by an external force, it will form a linkage with the strike column 3, the rotating disc 6 is driven to rotate on the fixed disc 5 by the strike column 3, and at the same time, an unimpacted side of the impact arm 7 will swing towards a trainer under the impact force to strike. The trainer can dodge or block the impact arm 7 to achieve a training purpose, and there is a locking disc 8 between the fixed disc 5 and the rotating disc 6 that locks the two longitudinally, thereby preventing the rotating disc 6 from detaching from the fixed disc 5 during rotation. During installation, the fixed disc 5 is firstly connected with the rotating disc 6 through the locking disc 8 to form the rotating component 4. Then, the rotating component 4 is then connected with a top of the inflation column 2 and a bottom of the strike column 3.

In an implementation mode of the present disclosure, an inner of the base 1 is in a shape of a cavity for accommodating air and liquid. A side wall of the base 1 is provided with a water injection hole 9 and a puncture 10. The water injection hole 9 and the puncture 10 are respectively provided with a plug 11 for entering liquid and gas. The plug 11 is connected to a detachable plug body 12, and there is also a backstop member 13 inside the plug 11. Side walls of the inflation column 2 and the strike column 3 are both provided with the puncture 10, The puncture 10 is provided with the plug 11 for air inlet.

By adopting the above technical solution, in order to ensure the stability of the entire training inflation device for base 1, a certain amount of liquid can be injected into the water injection hole 9 to render it have sufficient weight to prevent the inflation device from collapsing when the inflation column 2 and strike column 3 are subjected to an impact force. The puncture 10 can inject gas to render base 1 bulge and support the inflation column 2 and strike column 3. After inflation and liquid injection are completed, the plug body 12 is placed into the plug 11. The plug body 12 and the backstop member 13 form two closed defense lines to prevent gas and liquid leakage. The backstop member 13 on the water injection hole 9 may not be provided with the backstop member 13, which facilitates the discharge of gas and liquid from a container. The gas inside can be discharged through the backstop member 11 on the inflation column 2 and the strike column 3, allowing the inflation column 2 and the strike column 3 to quickly exhaust the gas inside. Users can fold and store the base 1, inflation column 2, and strike column 3 after venting and discharging the liquid.

In an implementation mode of the present disclosure, a roller piece 14 is clamped between the rotating disc 6 and the fixed disc 5 to reduce a friction force between the rotating disc 6 and the fixed disc 5 during rotation. The roller piece 14 is provided with a circular belt 15, on which there are multiple spheres 16. A middle of the fixed disc 5 is provided with a placement groove 17 for placing the roller piece 14, and there is a horizontal plane tangent to the sphere 16 inside the rotating disc 6. A middle of the fixed disc 5 is provided with a screw seat 18 for forming a fit with the locking disc 8. The screw seat 18 is provided with multiple threaded holes, and the locking disc 8 is provided with an opening for inserting a screw.

By adopting the above technical solution, during installation, the roller piece 14 is placed in the placement groove 17, and then the rotating disc 6 is buckled onto the fixed disc 5. Then, the locking disc 8 is placed on an upper end of the rotating disc 6 to align with the screw seat 18. The installation can be completed by screwing the screw into the opening and threaded holes. When the rotating disc 6 rotates, the fixed disc 5 does not rotate, and a horizontal plane tangent to the sphere 16 is provided in the rotating disc 6 to reduce the friction between the two.

In an implementation mode of the present disclosure, the circular belt 15 is provided with a limit ring 181 limiting the sphere 16. A bottom of the limit ring 181 is provided with an opening for the placement of the sphere 16, and the limit ring 181 gradually shrinks from bottom to top. A height of the limit ring 18 is lower than that of the sphere 16, and an upper end of the sphere 16 protrudes from the limit ring 181.

By adopting the above technical solution, after installing the roller piece 14, the limit ring 181 can limit a movement range of the sphere 16, so that it can only rotate within the limit ring 181. A top of the limit ring 181 is provided with a horizontal surface that is tangent to the sphere 16 in the rotating disc 6 for contact. To further reduce the friction force between a contact point between the sphere 16 and the rotating disc 6, lubricating oil can be applied to the contact point between the rotating disc 6 and the sphere 16.

In an implementation mode of the present disclosure, the impact arm 7 and the strike column 3 are internally formed, and the air holding chamber provided in the impact arm 7 is communicated with the cavity for holing air provided in the strike column 3. A front side and a rear side of the impact arm 7 are horizontal planes.

By adopting the above technical solution, when inflating the strike column 3, the impact arm 7 will also be inflated. After inflation is completed, the strike column 3 and the impact arm 7 are in a bulging state. At this time, the front and rear sides of the impact arm 7 are horizontal, better accepting blows from the first or foot.

In an implementation mode of the present disclosure, the backstop member 13 is provided with a shield piece 19 and an air passage seat 20. The air passage seat 20 is provided with multiple air passage holes 21, and the air passage seat 20 is arranged inside the plug 11. The air passage seat 20 and the plug 11 are detachably connected. The shield piece 19 is arranged at a tail end of the air passage seat 20, and the shield piece 19 has elasticity.

By adopting the above technical solution, during inflation, the gas enters the chamber through the air passage seat 20 and the air passage hole 21. When the airflow enters, it will blow open the shield piece 19 that is blocked on the air passage hole 21. The shield piece 19 is made of rubber material with elasticity and can undergo deformation. After inflation, it can reset and fit on the air passage hole 21. At the same time, the air pressure inside the chamber is relatively high, while the air pressure outside the chamber is relatively low. The gas inside the chamber will compress the shield piece 19. By further pressing it against the air passage seat 20, the plug body 12 can be placed into the air passage seat 20 to further enhance air tightness. When venting, the air passage seat 20 can be removed from the plug 11. After disassembly, the plug 11 is in an unobstructed structure where gas can flow out quickly.

In an implementation mode of the present disclosure, there is a connection seat 22 in a middle of the air passage seat 20 for fixing the shield piece 19. A middle of the connection seat 22 is provided with an opening for the shield piece 19 to pass through. A middle of the shield piece 19 is provided with a column, and an inclined circular platform provided at a middle of the column is an insertion head 23.

By adopting the above technical solution, when inserting the shield piece 19, aligning a smaller radius end of the insertion head 23, that is, aligning a top of the insertion head 23 with the opening for the shield piece 19 to pass through, and the head end of the column is pulled to the middle of the shield piece 19 to render the head end of the insertion head 23 enter the opening. The shield piece 19 is made of rubber material. When the insertion head 23 is pulled, the lower end of the insertion head 23 with a larger radius will be affected by tensile force for deformation and reduction. After fully passing through the opening provided by the connection seat 22, the insertion head 23 can be reset without being squeezed by the opening. After resetting, the lower end of the insertion head 23 will fit with a top surface of the connection seat 22. Moreover, due to the circular shape of the insertion head 23, a lower radius is greater than the upper radius, so a bottom of the insertion head 23 will clamp the connection seat 22 tightly and cannot enter the opening. At this point, the air is pumped into the air passage seat 20, and an upper end of the shield piece 19 is fixed by the connection seat 22. A lower end is blown by the airflow and pushed towards one side of the chamber. At this time, the middle of the shield piece 19 is stretched by force. After the inflation is completed, the elastic deformation of the shield piece 19 is completed, and it automatically resets, which can be tightly attached to the air passage hole 21, and thereby enhancing air tightness.

In an implementation mode of the present disclosure, a diameter of base 22 is greater than that of inflation column 2 and greater than that of the impact column 3, and an outer side of the impact arm 7 is arranged within a diameter range of the base 1.

By adopting the above technical solution, the stability of the training inflation device is ensured.

Working principle: when the impact arm 7 is subjected by an external force, it will form a linkage with the impact column 3, the rotating disc 6 is driven to rotate on the fixed disc 5 by the impact column 3. At the same time, the unimpacted side of the impact arm 7 will swing towards the trainer under the impact force. The trainer can dodge or block the impact arm 7 to achieve the training purpose. When the rotating component 4 rotates, a top of the limit ring 181 is provided with a horizontal surface that is tangent to the sphere 16 and is exposed to the rotating disc 6 for contact, further reducing the friction force at the contact point between the sphere 16 and the rotating disc 6, allowing the rotating component 4 to rotate smoothly.

The above embodiments only express several embodiments of the present disclosure, and their descriptions are more specific and detailed, but cannot be understood as limiting the scope of the disclosure patent. It should be pointed out that for ordinary technical personnel in this field, several deformations and improvements can be made without departing from the concept of the present disclosure, all of which fall within the protection scope of the present disclosure. Therefore, the protection scope of the present disclosure patent should be based on the attached claims.

What is claimed is:

1. A boxing training inflation device, comprising a base, wherein the base is provided with an inflation column, the base limits a movement direction of the inflation column; the inflation column is provided with a strike column that is configured to be struck, a rotating component is provided between the inflation column and the strike column to connect the inflation column and the strike column;

the rotating component is composed of a fixed disc and a rotating disc;

two sides of the strike column are further provided each with an impact arm, the impact arms form a linkage with the strike column when being subjected by an external force, and the rotating disc is driven to rotate on the fixed disc by the strike column;

a locking disc is provided between the fixed disc and the rotating disc to longitudinally lock the fixed disc and the rotating disc, thereby preventing the rotating disc from detaching from the fixed disc during rotation.

2. The boxing training inflation device according to claim 1, wherein an inner of the base is in a shape of a cavity accommodating air and liquid, a side wall of the base is provided with a water injection hole and a puncture, and the water injection hole is provided with a plug for entering liquid, the puncture is provided with the plug for entering air, the plug is connected to a detachable plug body, the plug is further provided with a backstop member, and side walls of the inflation column and the strike column are both provided with an additional puncture, and the punctures are is provided with plugs for air inlet.

3. The boxing training inflation device according to claim 2, wherein a roller piece is clamped between the rotating disc and the fixed disc to reduce a friction force between the rotating disc and the fixed disc when the rotating disc and the fixed disc rotate;

the roller piece is provided with a circular belt, multiple spheres are on the circular belt, and a placement groove for placing the roller piece is provided in a middle of the fixed disc, the rotating disc is provided with a horizontal plane tangent to the sphere;

a middle of the fixed disc is provided with a screw seat for forming a fit with the locking disc, the screw seat is provided with multiple threaded holes, and the locking disc is provided with an opening for inserting a screw.

4. The boxing training inflation device according to claim 3, wherein the circular belt is provided with a limit ring limiting the sphere;

a bottom of the limit ring is provided with an opening for inserting the sphere;

the limit ring gradually shrinks from bottom to top, and a height of the limit ring is lower than that of the sphere;

an upper end of the sphere protrudes from the limit ring.

5. The boxing training inflation device according to claim 4, wherein the impact arm and the strike column are integrally formed, and an air holding chamber provided in the impact arm is communicated with the cavity for holding air provided in the strike column, and a front side and a rear side of the impact arm are horizontal planes.

6. The boxing training inflation device according to claim 5, wherein each of the backstops members of the plugs is provided with a shield piece and an air passage seat, wherein the air passage seat is provided with multiple air passage holes; the air passage seat is arranged in the plug, and the air passage seat and the plug are detachably connected;

the shield piece is provided at a tail end of the air passage seat, and the shield piece has elasticity.

7. The boxing training inflation device according to claim 6, wherein a middle of each of the air passage seats is provided with a connection seat for fixing the shield piece, a hole is provided in a middle of the connection seat for the shield piece to pass through;

a column is provided in a middle of the shield piece;

a tilted circular platform provided in a middle of the column is an insertion head.

8. The boxing training inflation device according to claim 7, wherein a diameter of the base is greater than a diameter of the inflation column and greater than a diameter of the strike column, and an outer side of the impact arm is arranged within a diameter range of the base.

* * * * *